US007400301B2

(12) United States Patent
Chan

(10) Patent No.: US 7,400,301 B2
(45) Date of Patent: Jul. 15, 2008

(54) ANTENNA DEVICE HAVING ROTATABLE STRUCTURE

(75) Inventor: Yat To Chan, Tauyuan Hsien (TW)

(73) Assignee: Joymax Electronics Co., Ltd., Chongli Gonyeh Chu, Chongli Tauyuan Hsien (TW)

( * ) Notice: Subject to any disclaimer, the term of this patent is extended or adjusted under 35 U.S.C. 154(b) by 404 days.

(21) Appl. No.: 11/131,775

(22) Filed: May 17, 2005

(65) Prior Publication Data

US 2006/0273980 A1 Dec. 7, 2006

(51) Int. Cl.
*H01Q 1/24* (2006.01)

(52) U.S. Cl. ..... 343/702; 343/906

(58) Field of Classification Search ..... 343/882, 343/906, 702, 880, 916
See application file for complete search history.

(56) References Cited

U.S. PATENT DOCUMENTS 5,836,005 A 11/1998 Chang ..... 343/702
5,973,645 A 10/1999 Zigler et al. ..... 343/702
7,046,212 B2 * 5/2006 Tai et al. ..... 343/882

* cited by examiner

*Primary Examiner*—Hoang V Nguyen
*Assistant Examiner*—Robert Karacsony
(74) *Attorney, Agent, or Firm*—Charles E. Baxley

(57) ABSTRACT

An antenna device includes a coupler rotatably attaching to a support device, a connector rotatably attached to the coupler with a pivot axle and having an aperture formed in a free end, and having a stop. An antenna member includes an extension extended from one end for rotatably engaging into the aperture of the connector. The antenna member includes a stop for engaging with the stop of the connector, and for limiting the antenna member to rotate relative to the connector. The connector includes a number of grooves, for engaging with a projection of the antenna member, to position the antenna member to the connector at selected or predetermined angular position.

6 Claims, 4 Drawing Sheets

ANTENNA DEVICE HAVING ROTATABLE STRUCTURE

BACKGROUND OF THE INVENTION

1. Field of the Invention

The present invention relates to an antenna device, and more particularly to an antenna device having a rotatable structure for allowing the antenna device to be freely rotated relative to the support object or device to any angular direction.

2. Description of the Prior Art

Typical antenna devices comprise an antenna housing or member solidly attached or secured onto a telecommunicating facility or the other support objects or devices, and some of the antenna housings or members may include a telescopic structure for selectively extending out of the telecommunicating facility or the other support objects or devices.

For example, U.S. Pat. No. 5,836,005 to Chang discloses one of the typical portable telephones including a mobile telephone antenna that is extendibly secured to the typical portable telephone, and extendible inwardly and outwardly relative to the typical portable telephone. However, the antenna may not be rotated relative to the typical portable telephone to selected angular positions, such that the typical portable telephones may not easily receive telecommunicating signals.

U.S. Pat. No. 5,973,645 to Zigler et al. discloses another typical electric facility including an antenna device rotatably secured to the typical hand held electric facility, for being rotated relative to the typical electric facility to various angular directions. However, the antenna device of the typical electric facility may only be rotated relative to the typical electric facility in one direction only, and may not be freely rotated relative to the typical electric facility to any suitable or selected directions.

The present invention has arisen to mitigate and/or obviate the afore-described disadvantages of the conventional antenna devices for telecommunicating facilities.

SUMMARY OF THE INVENTION

The primary objective of the present invention is to provide an antenna device including a rotatable structure for allowing the antenna device to be freely rotated relative to the support object or device to any angular direction.

In accordance with one aspect of the invention, there is provided an antenna device comprising a coupler including a first end for rotatably attaching to a support device, and including a second end, a connector including a first end rotatably attaching to the second end of the coupler with a pivot axle, and including an aperture formed therein, and including a second end having a stop extended therein, and an antenna member including a first end having an extension extended therefrom, for rotatably engaging into the aperture of the connector, and including a flange extended from the extension, for engaging with the connector, and for rotatably coupling the first end of the antenna member to the connector, the antenna member including a stop extended therefrom, for engaging with the stop of the connector, and for limiting the antenna member to rotate relative to the connector, and for preventing the antenna member from being over rotated relative to the connector, and for preventing the electric cables or wires that are coupled between the antenna member and the connector from being twisted or broken or damaged.

The antenna member includes a stud extended therefrom and having a peripheral channel formed in the stud for slidably receiving the stop of the connector, and also includes a stop extended into the peripheral channel thereof, for engaging with the stop of the connector, and for limiting the antenna member to rotate relative to the connector.

The connector includes an opening formed in the second end thereof, for rotatably receiving the stud of the antenna member, in which the stop of the connector is extended into the opening of the connector.

The connector includes a plurality of grooves formed in the second end thereof, and the antenna member includes a projection extended therefrom, for engaging into either of the grooves of the connector, and for anchoring and positioning the antenna member to the connector at selected angular position. The antenna member includes at least one slit formed in the extension thereof, for increasing a resilience of the extension thereof.

The antenna member includes a bore formed therein, and a tube received in the bore of the antenna member, to reinforce the extension of the antenna member, and to prevent the extension of the antenna member from being distorted. The coupler includes at least one slot formed in the second end thereof to form at least one spring arm.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
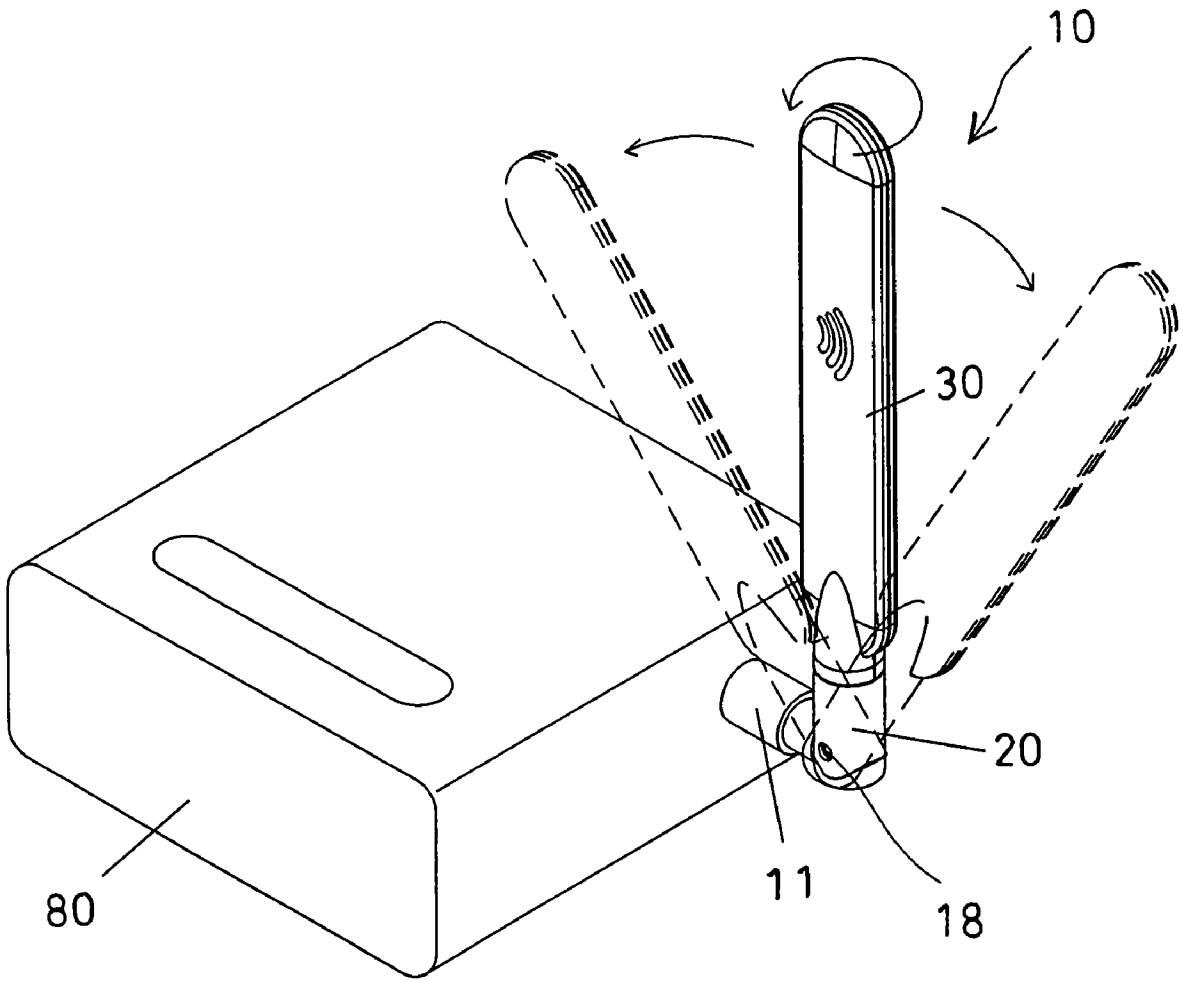
FIG. 1 is a perspective view illustrating an attachment of an antenna device in accordance with the present invention onto a telecommunicating facility or electric facility or other support objects or devices.
Figure 2:
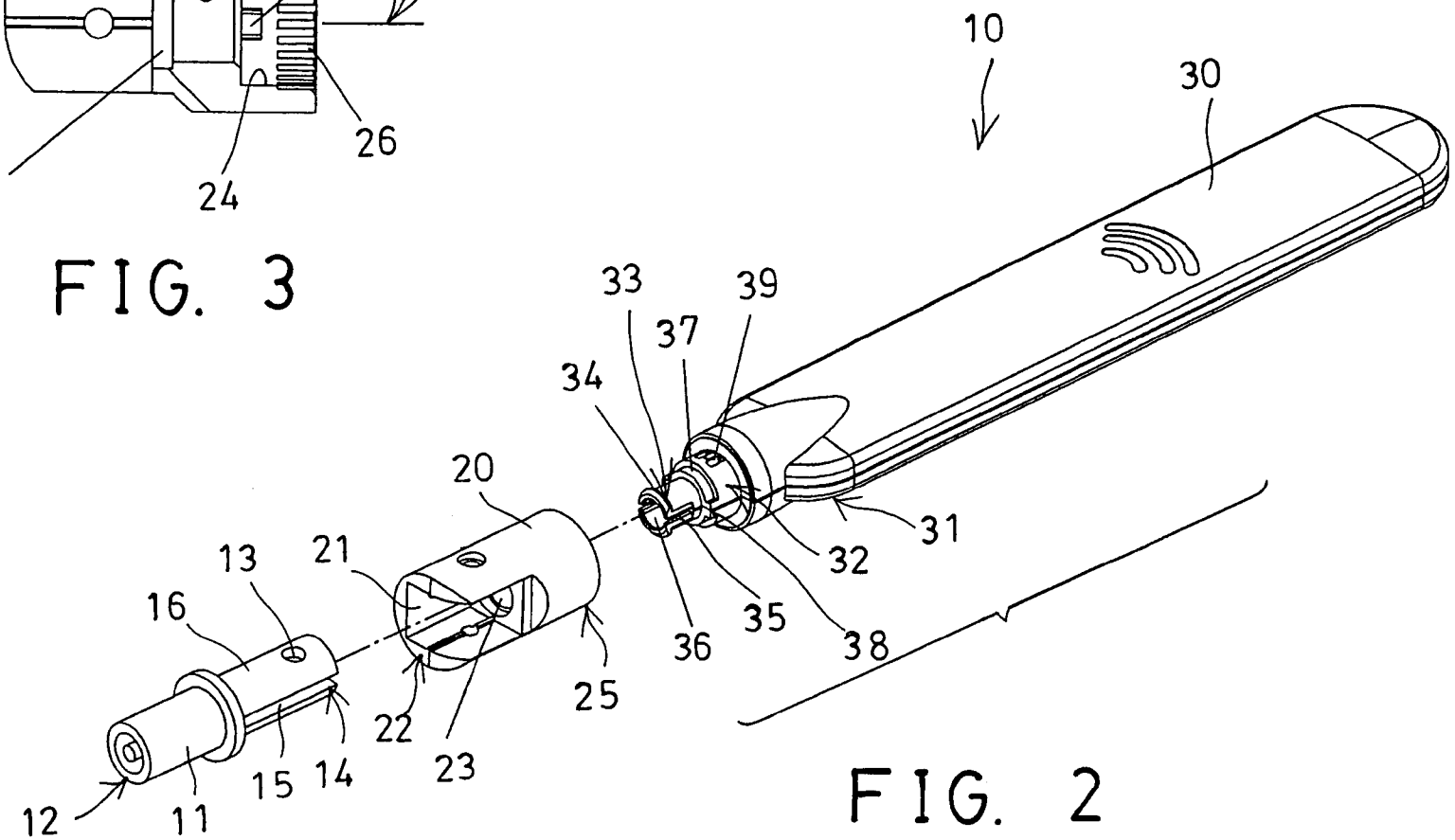
FIG. 2 is a partial exploded view of the antenna device.

Referring to the drawings, and initially to FIGS. 1 and 2, an antenna device 10 in accordance with the present invention is provided or arranged for pivotally or rotatably attached to a telecommunicating facility or electric facility or other support objects or devices 80, and comprises a coupler 11 including one end 12 for pivotally or rotatably plugging or attaching to the telecommunicating facility or support device 80, and including an orifice 13 formed in the other end 14 thereof, and preferably further including one or more slots 15 formed in the other end 14 thereof to form one or more spring arms 16.

Figure 5:
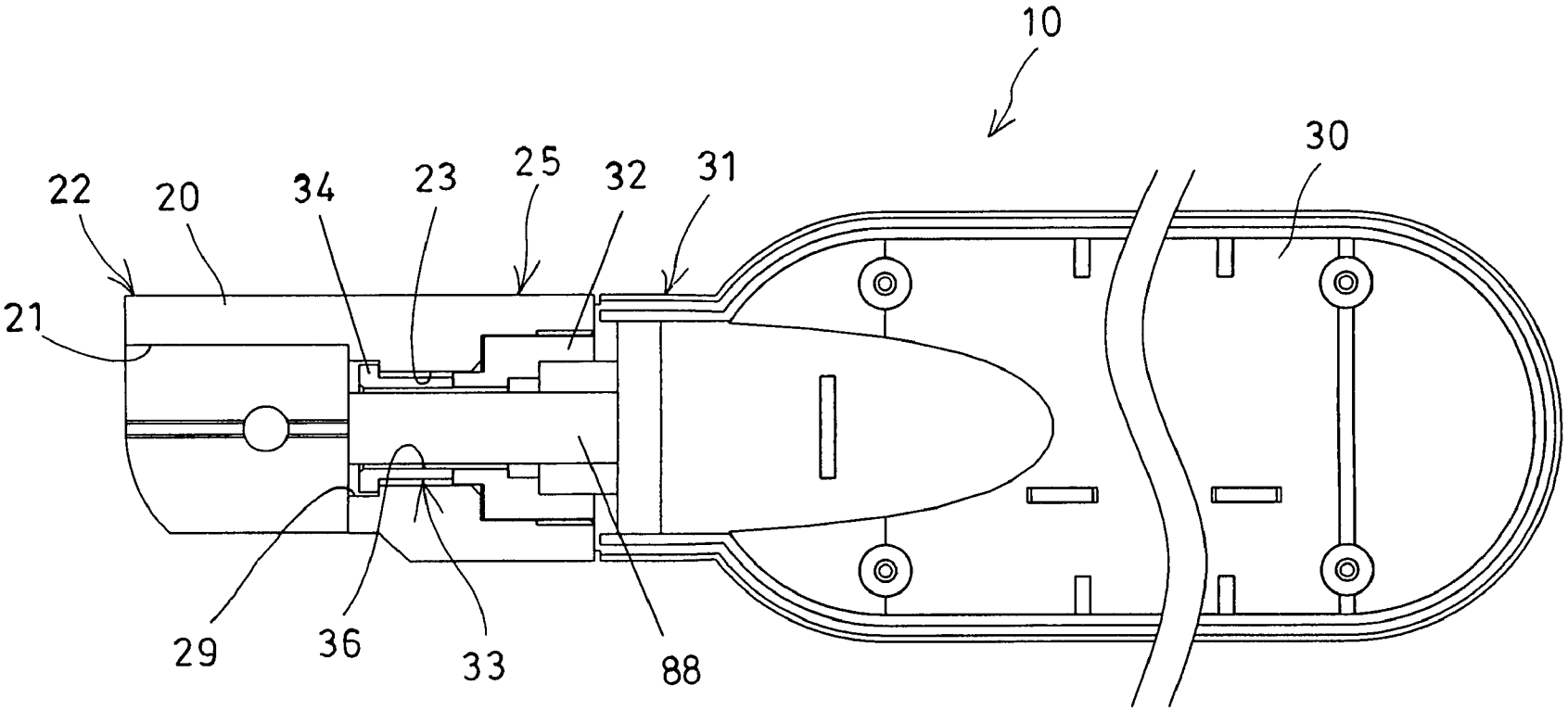
FIG. 5 is a partial cross sectional view similar to FIG. 4, illustrating the other arrangement of the antenna device.

A connector 20 includes a chamber 21 formed therein, such as formed in one end 22 thereof, for rotatably receiving or attaching the other end 14 of the coupler 11, and may be pivotally or rotatably coupled to the coupler 11 with a pivot axle 18 (FIG. 1), to allow the connector 20 to be rotated relative to the coupler 11 about the pivot axle 18. The connector 20 includes an aperture 23 formed therein and communicating with the chamber 21 thereof, for selectively or optionally receiving such as a protective tube 88 therein (FIG. 5), and/or for storing or receiving electric cables or wires (not shown) therein, and/or for reinforcing purposes.

Figure 3:
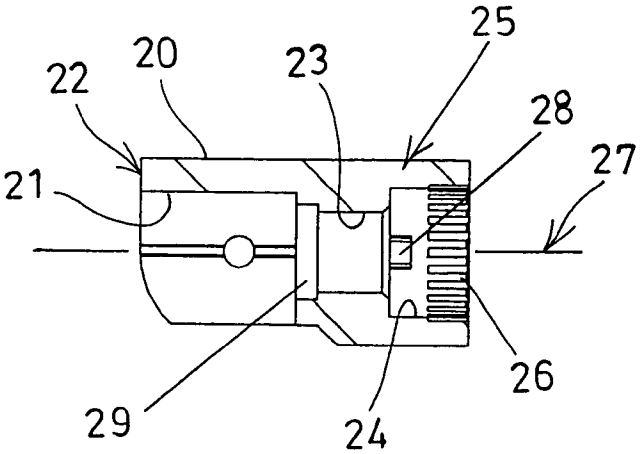
FIG. 3 is an enlarged partial cross sectional view illustrating a connector of the antenna device.
Figure 4:
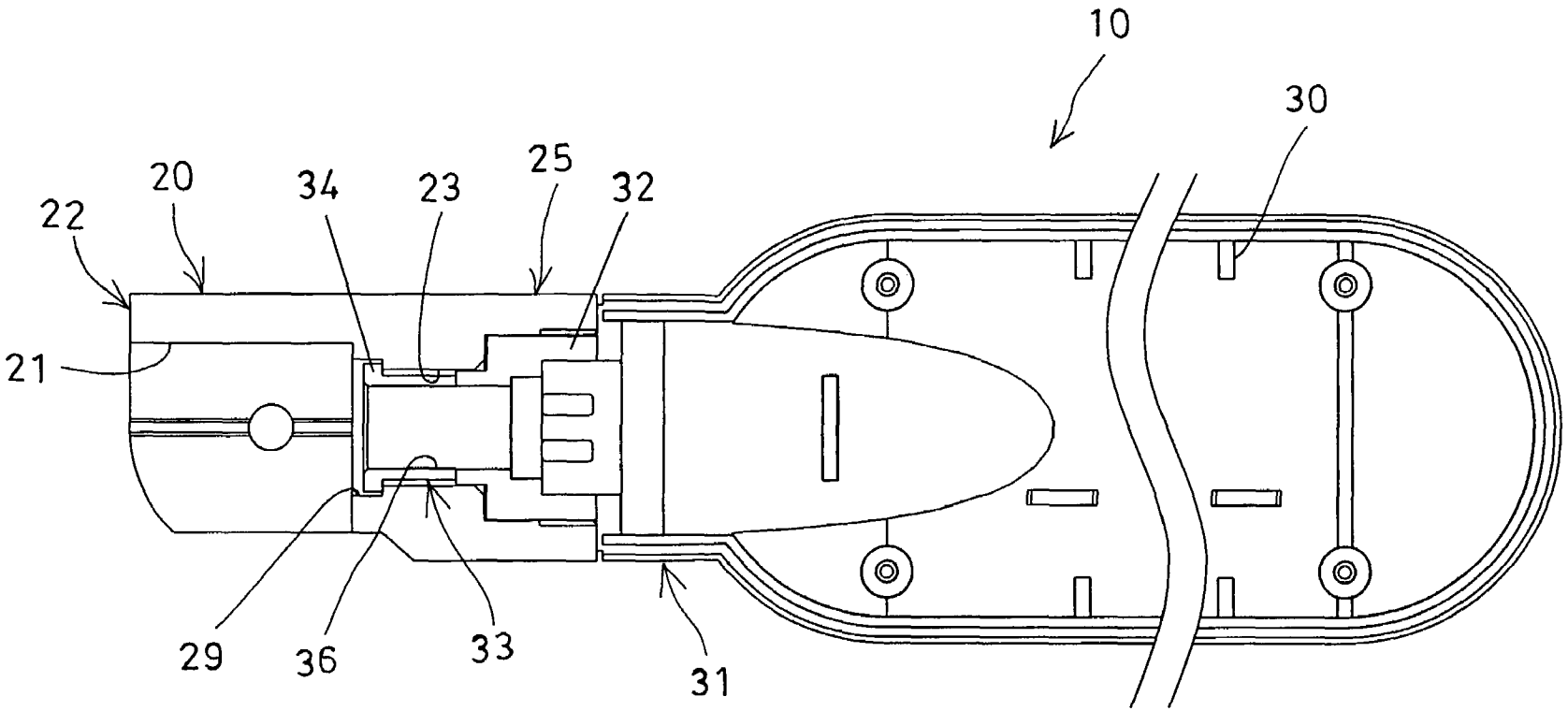
FIG. 4 is a partial cross sectional view of the antenna device, taken along lines 4-4 of FIG. 1.

As best shown in FIG. 3, the connector 20 includes an enlarged opening 24 formed in the other end 25 thereof, and includes a number of grooves 26 also formed in the other end 25 thereof and communicating with the opening 24 thereof, and substantially parallel to a longitudinal axis 27 of the connector 20, and includes a stop 28 extended radially and inwardly into the opening 24 thereof, and further includes an enlarged peripheral shoulder 29 formed in the middle portion or the intermediate portion thereof, and communicating with and located between the chamber 21 and the aperture 23 thereof.

An antenna housing or member 30 includes one end 31 having a stud 32 extended therefrom and having a reduced outer diameter than that of the antenna member 30, for rotatably receiving or engaging into the opening 24 of the connector 20, and includes an extension 33 further extended from the stud 32 and having a reduced outer diameter than that of the stud 32, for rotatably receiving or engaging into the aperture 23 of the connector 20, and includes a peripheral flange 34 extended from the free end portion of the extension 33, for rotatably engaging into the peripheral shoulder 29 of the connector 20, and for engaging with the connector 20, to rotatably secure the stud 32 and having a reduced outer diameter than that of the stud 32 and the extension 33 of the antenna member 30 to the connector 20.

It is preferable that the antenna member 30 including one or more slits 35 formed in the one end 31 thereof, particularly formed in the extension 33 thereof, for increasing a resilience of the extension 33 thereof, and for allowing the extension 33 thereof to be easily engaged through the aperture 23 of the connector 20. The antenna member 30 further includes a bore 36 formed therein, for receiving the protective tube 88 therein (FIG. 5) which may be used to receive the electric cables or wires (not shown) therein, to reinforce the stud 32 and the extension 33 of the antenna member 30.

The antenna member 30 further includes a peripheral channel 37 formed in the stud 32 for rotatably or slidably receiving the stop 28 of the connector 20, and also includes a stop 38 extended into or within the peripheral channel 37 thereof, for engaging with the corresponding stop 28 of the connector 20, and thus for limiting the antenna member 30 to rotate relative to the connector 20, and for preventing the antenna member 30 from being over rotated relative to the connector 20, to prevent the electric cables or wires (not shown) that are coupled between the antenna member 30 and the connector 20 from being twisted.

The antenna member 30 further includes a projection 39 extended radially and outwardly from the stud 32 thereof, for selectively engaging into either of the grooves 26 of the connector 20, and thus for stably anchoring or positioning the antenna member 30 to the connector 20 at selected or predetermined angular positions. It is to be noted that the protective tube 88 (FIG. 5) may be engaged in the stud 32 and the extension 33 of the antenna member 30, to reinforce and to prevent the stud 32 and the extension 33 of the antenna member 30 from being deformed or disengaged from the connector 20.

The antenna member 30 may thus be rotated relative to the connector 20 at selected or predetermined angular positions, and the connector 20 may be rotated relative to the coupler 11, and the coupler 11 may be freely rotated relative to the telecommunicating facility or support device 80 to any suitable angular positions, such that the antenna member 30 may be freely rotated relative to the telecommunicating facility or support device 80 to any suitable angular positions.

Accordingly, the antenna device in accordance with the present invention includes a rotatable structure for allowing the antenna device to be freely rotated relative to the support object or device to any angular direction.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An antenna device comprising:

a coupler including a first end for rotatably attaching to a support device, and including a second end, a connector including a first end rotatably attaching to said second end of said coupler with a pivot axle, and including an aperture formed therein, and including a second end having a stop extended therein, and an antenna member including a first end having an extension extended therefrom, for rotatably engaging into said aperture of said connector, and including a flange extended from said extension, for engaging with said connector, and for rotatably coupling said first end of said antenna member to said connector, said antenna member including a stop extended therefrom, for engaging with said stop of said connector, and for limiting said antenna member to rotate relative to said connector, and for preventing said antenna member from being over rotated relative to said connector, said antenna member including a stud extended therefrom and having a peripheral channel formed in said stud for slidably receiving said stop of said connector, and said stop of said antenna member being extended into said peripheral channel thereof for engaging with said stop of said connector and for limiting said antenna member to rotate relative to said connector.

2. The antenna device as claimed in claim 1, wherein said connector includes an opening formed in said second end thereof, for rotatably receiving said stud of said antenna member, said stop of said connector is extended into said opening of said connector.

3. The antenna device as claimed in claim 1, wherein said connector includes a plurality of grooves formed in said second end thereof, and said antenna member includes a projection extended therefrom, for engaging into either of said grooves of said connector, and for anchoring and positioning said antenna member to said connector at selected angular position.

4. The antenna device as claimed in claim 1, wherein said antenna member includes at least one slit formed in said extension thereof, for forming and providing a resilience to said extension thereof.

5. The antenna device as claimed in claim 1, wherein said antenna member includes a bore formed therein, and a tube received in said bore of said antenna member, to reinforce said extension of said antenna member.

6. The antenna device as claimed in claim 1, wherein said coupler includes at least one slot formed in said second end thereof to form at least one spring arm.

* * * * *